US008650828B2

(12) United States Patent
Günther

(10) Patent No.: US 8,650,828 B2
(45) Date of Patent: Feb. 18, 2014

(54) REINFORCED CONCRETE COMPONENT REINFORCED WITH Z-SHAPED SHEET METAL PIECES

(75) Inventor: Gerd Günther, Bad Orb (DE)

(73) Assignee: Technische Hochschule Mittelhessen, Gießen (DE)

( * ) Notice: Subject to any disclaimer, the term of this patent is extended or adjusted under 35 U.S.C. 154(b) by 0 days.

(21) Appl. No.: 13/387,594

(22) PCT Filed: Jul. 19, 2010

(86) PCT No.: PCT/EP2010/060384

§ 371 (c)(1),
(2), (4) Date: Mar. 21, 2012

(87) PCT Pub. No.: WO2011/012480

PCT Pub. Date: Feb. 3, 2011

(65) Prior Publication Data

US 2012/0167519 A1 Jul. 5, 2012

(30) Foreign Application Priority Data

Jul. 31, 2009 (DE) ..... 10 2009 035 799
Dec. 5, 2009 (DE) ..... 10 2009 056 830

(51) Int. Cl.
*E04C 5/16* (2006.01)

(52) U.S. Cl.
USPC ..... 52/677; 52/742.14; 52/649.8

(58) Field of Classification Search
USPC ..... 52/677, 687, 689, 742.14, 649.1, 649.6, 52/649.8, 649.7; 264/279.1, 279, 35
See application file for complete search history.

(56) References Cited

U.S. PATENT DOCUMENTS

| | | | | | |
|---|---|---|---|---|---|
| 1,613,351 | A | * | 1/1927 | Klinger et al. | 404/135 |
| 2,886,370 | A | * | 5/1959 | Liebert | 294/89 |
| 2,911,819 | A | | 11/1959 | John | |
| 3,673,753 | A | * | 7/1972 | Anderson | 52/685 |
| 3,763,613 | A | * | 10/1973 | Wise | 52/447 |
| 4,085,559 | A | * | 4/1978 | Ilukowicz | 52/687 |
| 4,644,727 | A | * | 2/1987 | Hanson et al. | 52/687 |
| 4,835,933 | A | * | 6/1989 | Yung | 52/685 |

(Continued)

FOREIGN PATENT DOCUMENTS

| | | | |
|---|---|---|---|
| CH | 412 275 | A | 4/1966 |
| DE | 2727159 | A1 | 12/1978 |

(Continued)

OTHER PUBLICATIONS

International Search Report and Written Opinion for PCT/US2010/060384, mailed Sep. 9, 2010.

(Continued)

*Primary Examiner* — Brent W Herring
(74) *Attorney, Agent, or Firm* — Marshall, Gerstein & Borun LLP; Michael P. Furmanek

(57) ABSTRACT

A reinforced concrete component with at least one upper and at least one lower longitudinal reinforcement layer, and one transverse force reinforcement, wherein the latter is passed above an uppermost and a lowermost longitudinal reinforcement in its extension. The transverse force reinforcement is formed by at least 20 trapezoidal or triangular sheet metal components made from structural steel. Each sheet metal component has at its two ends one splay/chamfer. The chamfer is passed to the uppermost or lowermost longitudinal reinforcement, respectively.

15 Claims, 4 Drawing Sheets

(56) References Cited

U.S. PATENT DOCUMENTS

| | | | | |
|---|---|---|---|---|
| 4,901,498 | A * | 2/1990 | Gerwick, Jr. | 52/649.1 |
| 6,557,317 | B2 * | 5/2003 | Sorkin | 52/684 |
| 6,837,017 | B2 * | 1/2005 | Hardy et al. | 52/685 |
| 6,883,289 | B2 * | 4/2005 | Juedes et al. | 52/687 |
| 7,497,059 | B2 * | 3/2009 | Bennett | 52/677 |
| 7,584,585 | B2 * | 9/2009 | Kilby | 52/677 |
| 2004/0065034 | A1 * | 4/2004 | Messenger et al. | 52/309.11 |
| 2008/0209843 | A1 | 9/2008 | Helms | |
| 2009/0217612 | A1 * | 9/2009 | Window | 52/414 |

FOREIGN PATENT DOCUMENTS

| | | | |
|---|---|---|---|
| DE | 29812676 | U1 | 12/1998 |
| DE | 20309548 | U1 | 9/2003 |
| EP | 928859 | A1 | 7/1999 |
| EP | 1 055 784 | A1 | 11/2000 |
| EP | 1180565 | A1 | 2/2002 |
| FR | 2303133 | A1 | 10/1976 |
| WO | WO-2004/081313 | A1 | 9/2004 |
| WO | WO-2005/035900 | A1 | 4/2005 |
| WO | WO-2006/061461 | A1 | 6/2006 |
| WO | WO-2006/061462 | A1 | 6/2006 |

OTHER PUBLICATIONS

International Search Report and Written Opinion for PCT/EP2010/060389, mailed Sep. 15, 2010.

* cited by examiner

REINFORCED CONCRETE COMPONENT REINFORCED WITH Z-SHAPED SHEET METAL PIECES

CROSS-REFERENCE TO RELATED APPLICATIONS

This is the U.S. National Stage of International Patent Application No. PCT/EP2010/060384, having an international filing date of Jul. 19, 2010, and which claims priority benefit of German application number 10 2009 035 799.8, filed Jul. 31, 2009 and German application number 10 2009 056 830.1, filed Dec. 5, 2009, the contents of each of the foregoing applications hereby being incorporated herein in the entirety.

FIELD OF DISCLOSURE

The present disclosure relates to a concrete component with at least one upper and at least one lower longitudinal reinforcement layer, and a transverse force reinforcement, wherein its extension is passed above the uppermost and lowermost longitudinal reinforcement.

BACKGROUND

In reinforced concrete or prestressed concrete components, shear reinforcement is often required in the area of column connections, in particular in the area of prop connectors, in order to absorb the transverse forces occurring due to column forces.

Such shear reinforcement elements are widely known in the form of S-Hooks or stirrups, dowel bars, double-headed bolts, stirrup meshes, open web girders, Tobler Walm®, "Geilinger" collars, and "Riss" stars.

Due to bad anchorage, shear reinforcement in the form of S-hooks or stirrups has to grasp a usually available flexural longitudinal reinforcement in order to prevent the shear reinforcement from being ripped out. The installation procedure is highly time-consuming and therefore also cost-intensive. Conventional stirrups are no longer considered suitable to be fitted at high degrees of reinforcement in the bending tensile reinforcement and at a high proportion of reinforcement.

In the dowel bar known from DE 27 27 159 A1, the dowels are provided with an enlarged dowel head at their end. The dowels are welded at their other end to a dowel support rail. A further development of such a dowel bar is known, for example, from DE 298 12 676 U1. This dowel bar comprises several dowels arranged at a specific distance from one another; these dowels comprise an extended plate-shaped dowel head at one end of the dowel shaft and are attached to a joint dowel support rail at the other end, wherein the respective dowel shaft extends through a dowel drill hole in the dowel support rail, and is provided with a rivet head.

Though such dowel bars are used in diverse ways, practical experience has shown that these dowel bars fail when subjected to strong shear forces because the dowels then become bent. As a result, the connection between concrete and reinforcement becomes loose, and the durability of the concrete component cannot always be provided.

Double-headed bolts comprise a cylindrical bolt and an above or below-lying bolt head which is enlarged in comparison to the bolt and which is generally arranged in the approximate form of a truncated cone. Several such bolts are connected via a distance rail attached at the upper or lower bolt head to a shear reinforcement element, wherein the distance rail ensures correct orientation as well as the correct height position of the double-headed bolts in their state of assembly.

One disadvantage of this shear reinforcement element is that the production of these double-headed bolts is relatively time-consuming and is carried out, by way of example, by clinching the bolt ends to produce the bolt heads or by welding the bolt heads in the form of truncated cones to the bolt.

In addition, the double-headed bolts are usually threaded from above in a star-shaped manner between the upper and lower layer of the longitudinal reinforcement. With high degrees of reinforcement in the bending tensile reinforcement and different mesh openings in the upper and lower reinforcement layer, installation is therefore highly difficult, and is sometimes even impossible.

Tobler Walm® and "Geilinger" Collars are steel mounting components which consist of welded steel profiles and which are individually produced. Movement of the mounting components requires the use of lifting gear due to their high net weight. Production and installation are time-consuming and cost-intensive, as this lifting equipment is not available for other tasks on the construction site or has to be reserved specifically for this task. Due to their size and weight, these solutions cannot be used in prefabricated components, as transportation to the construction site would no longer be cost-efficient. These concrete reinforcement elements are therefore only suitable to be used for concrete components which are produced using on-site mixed concrete.

GENERAL DESCRIPTION

The aim of the present disclosure is to overcome these and other disadvantages of the state of the art by providing a concrete component which is also suitable for absorbing large shear forces or transverse forces. The reinforced concrete or prestressed concrete component also has to be suitable to be produced at a reasonable price and to be simple to install. Ideally, it also has to be producible as a prefabricated component.

For a reinforced concrete component with at least one upper and at least one lower longitudinal reinforcement layer, and one transverse force reinforcement, wherein the latter is passed above the uppermost and lowermost longitudinal reinforcement in its extension, the disclosure provides that the transverse force reinforcement is formed by at least 20 trapezoidal or triangular sheet metal components made from structural steel.

The advantageous arrangement according to the present disclosure of the transverse force reinforcement comprising at least 20 free-falling, trapezoidal or triangular sheet metal components made from structural steel ensures that there is good composite action between the concrete and the reinforcement due to the large number of elements. Such a concrete component is suitable to be produced at a reasonable price and has a high load-bearing capacity. Furthermore, the composite action is increased by the shape of the sheet metal component, as the sheet metal component is suitable to be wedged into the concrete.

The production costs of the concrete component are extremely low due to the arrangement of the transverse force reinforcement according to the present invention, as standard commercial structural steel is suitable to be used. Due to the simple geometry of the sheet metal components, they are suitable to be manufactured in series production as free-falling punched parts. As a result, no welding procedures, screw connections or soldered joints are required. The production costs of a concrete component according to the present disclosure are significantly reduced due to the arrangement of the transverse force reinforcement through simple sheet metal components. Furthermore, the production procedure of the sheet metal components by means of punching production requires very little energy.

They are quick and simple to mount, wherein no special knowledge or skills are required.

Aside from the punching shear strength, the shear resistance is also significantly increased in comparison to conventional constructions, as transverse forces and bending moments are absorbed more effectively and distributed more favorably within the reinforced concrete component. Cracks caused by transverse force therefore remain small, and the bearing load of the reinforced concrete component is suitable to be increased significantly in comparison to conventional solutions.

The shear force transmission in the shear joint, which can be detected in element slabs, is also absorbed by the sheet metal components. The production costs of a reinforced concrete component according to the present disclosure are therefore suitable to be further reduced.

The transverse force reinforcement is preferably formed from at least 50 sheet metal components, and particularly preferred from at least 70 sheet metal components. The strain in the reinforced concrete component can be distributed highly homogeneously through a large number of sheet metal components. This further increases the load-bearing capacity.

In order to further improve the composite action of the transverse force reinforcement in the reinforced concrete component according to the present invention, each sheet metal component has a chamfer at its two ends. The chamfer is hereby passed to the uppermost or lowermost longitudinal reinforcement. The arrangement according to the present invention ensures a better strain distribution within the zone of the reinforced concrete component subjected to transverse force. The sheet metal component, of which the cross-section is Z-shaped, thereby grasps at least one reinforcement bar of the upper and one of the lower longitudinal reinforcement layer with the simple chamfers, so that the punching shear reinforcement is successfully anchored without being prone to slippage in the concrete pressure and concrete tensile stress zone.

Two circular recesses are particularly preferably arranged within the chamfer at the broad end of the trapezoidal sheet metal component. Concrete is suitable to penetrate these circular recesses and therefore ensure a dovetailing of the sheet metal component with the concrete. The reinforced concrete component therefore obtains an extremely high load-bearing capacity. Furthermore, the sheet metal components are therefore firmly anchored and do not slip when the concrete is poured in.

A longitudinal reinforcement bar passed through each recess improves the load-bearing capacity of the reinforced concrete component according to the present disclosure, as forces introduced diagonally are divided into a normal force component and a transverse force component due to the composite action. As a result, the reinforced concrete component possesses further increased ductility.

The arrangement of the disclosure is then particularly advantageous when the chamfers are arranged with additional recesses. As a result, the composite action between the sheet metal components and the concrete in the reinforced concrete component is again further improved, and the load-bearing capacity of the reinforced concrete component is again increased.

Each sheet metal component comprises advantageously a thickness of 3 mm or 5 mm. Experiments carried out for the sake of the load-bearing capacity have shown that the optimum ratio of shear resistance with regard to the composite action is not achieved using alternatively selected thicknesses. Furthermore, the provision of only two sheet metal components is particularly beneficial with regard to material costs. The thickness of the sheet metal components does not have to be specifically adjusted. In fact, they are suitable to be produced on demand. Therefore, storage and provision costs are avoided. Only the length of the sheet metal components has to be adjusted to the respective ceiling thickness.

According to the present disclosure, the sheet metal components are arranged in a preferred embodiment with uniform distribution around an area with high transverse force. As a result, the calculation of the reinforced concrete component is suitable to be carried out using simple means and existing possibilities. Extensive calculations for each individual case are therefore suitable to be avoided. Furthermore, it is advantageous according to the present disclosure if the sheet metal components are arranged parallel to each other. As a result, simple geometries which serve to calculate the reinforced concrete component are suitable to be achieved. The construction of the reinforced concrete component according to the present invention is therefore easy to produce and is cost-effective.

The arrangement of the sheet metal components serving as reinforcement is concentrated into a core area during mounting into a reinforced concrete component. The large amount of reinforcement arranged there and the way in which this is achieved using sheet metal components significantly increases the punching shear strength of the concrete component. At a greater distance from the core area, which ideally lies in the area of the strongest transverse force, e.g. in the area of a column, the amount of sheet metal components is advantageously suitable to be reduced. The tangential distances of the reinforcement components are then suitable to be lengthened with increasing distance from the core area.

The arrangement of the invention is then particularly advantageous when the transverse force reinforcement is formed from so many Z-shaped sheet metal components made from structural steel that the equation $$\frac{\beta \cdot V_{Ed}}{u_{krit}} \leq v_{Rd,max}$$

is satisfied.

Hereby are:

$u_{krit}$ the circumference of the critical perimeter according to section 10.5.2 of DIN 1045-1 in consideration of the following specifications, wherein DIN 1045-1, section 10.5.2 (14) does not apply here.

The critical perimeter has to be executed according to DIN 1045-1, section 10.5.2 for internal columns and supports close to openings in the plate. Columns at a distance of less than 6 h from at least one plate edge are considered edge or corner columns, respectively. For these columns, the perimeter has to be executed in accordance with DIN 1045-1, FIG. 41, wherein the distance to the border has to be set to 6 h (instead of 3 d according to FIG. 41). The latter applies if the execution of a perimeter according to DIN 1045-1, FIG. 39, results in a smaller perimeter length.

β load increase factor for ceiling systems mounted in a horizontally immovable manner according to DIN 1045-1, FIG. 44, or to booklet 525 of the Committee for Reinforced Concrete (DAfStb), section 10.5.3.

$V_{Ed}$ the design values of the exposures affecting the components $$V_{Rd,max}=\alpha_{sheet\ metal}V_{Rd,ct}$$

wherein $\alpha_{sheet\ metal}$ is the factor to be considered when increasing the load-bearing capacity due to the sheet metals.

| | Thickness of sheet metal t [mm] | Reinforcement ds [mm] | $\alpha_{sheet\ metal}$ |
|---|---|---|---|
| GM-Z5/12 | 5 | 12 | 1.9 |
| GM-Z3/12 | 3 | 12 | 1.6 |

$V_{Rd,ct}$ is calculated for inner, edge and corner columns as follows:

In the critical perimeter, the shear resistance $V_{Rd,ct}$ of the plate contributes to determining the maximum load-bearing capacity:

$$v_{Rd,ct}=\left[0.14\cdot\kappa\cdot(100\cdot\rho_l\cdot f_{ck})^{\frac{1}{3}}\right]\cdot d$$

κ the scale factor according to equation (106) in DIN 1045-1, $\rho_l$ average degree of longitudinal reinforcement within the perimeter considered d static height of component Furthermore, it is advantageous if the transverse force reinforcement is formed from so many Z-shaped sheet metal components made from structural steel that the equation is satisfied.

Hereby corresponds:

$V_{Ed}$ the design values of the exposures affecting the components

β according to DIN 1045-1, FIG. 44 or according to booklet 525 of the Committee for Reinforced Concrete (DAfStb), section 10.5.3.

$V_{Rd,sy,Z}$ to the punching shear resistance of the sheet metal component $$V_{Rd,sy,Z}=k1\cdot v_{Rd,ct}\cdot u_i+b_{sheet\ metal}\cdot t_{sheet\ metal}\cdot f_{yd}\cdot n_{sheet\ metals}$$

k1=1.70 for the perimeter at a distance of 0.5 d from the edge of the column k1=1.35 for the perimeter at a distance of 1.25 d from the edge of the column k1=1.00 for perimeters at a distance of ≥2.0 d from the edge of the column $u_i$ circumference of the perimeter in the determined section considered $f_{yd}$ calculation value of the yield strength of the sheet metal component $b_{sheet\ metal}$ smallest web thickness of the sheet metal component $t_{sheet\ metal}$ thickness of the sheet metal component $n_{sheet\ metals}$ number of steel sheets in the perimeter considered A reinforced concrete component arranged in this way comprises a higher punching shear behavior than all comparable known solutions in the state of the art.

Furthermore, it is advantageous if the distances of the sheet metals towards the loaded surface (column) going in radii sr (radial direction) do not exceed the following values:

The distance of a sheet metal to the previous or following perimeter is not allowed to exceed 0.75 d.

The shortest distance between two sheet metals is not allowed to be less than the 3 cm.

Furthermore, the distances of the sheet metals to each other towards the course of the perimeters st (tangential direction) are advantageous within the following values:

$$s_t\leq 0.75\times d\times 0.8\times i\leq 3.5\times d$$

i number of the perimeter d static height of component

In this way, the highest load-bearing capacities are achieved according to the present disclosure.

One of the production methods of a reinforced concrete component according to the present disclosure provides that the sheet metal components are first threaded onto the lowest longitudinal reinforcement layer. The sheet metal components are subsequently situated towards the top, as they grasp the recesses of the longitudinal reinforcement in an interlocking manner and prevent overturning. The sheet metal components thereby protrude onto the upper longitudinal reinforcement layer or above it. The reinforcement then is poured into a batch with concrete. After the concrete hardens, the reinforced concrete component is finished and suitable to be charged.

Alternatively, it is also possible to thread the sheet metal components onto the uppermost layer of the longitudinal reinforcement. The sheet metal components then hang downwards and reach the lower longitudinal reinforcement layer. After pouring with concrete, the reinforced concrete component according to the present disclosure is also finished.

Particularly advantageous is to carry out the pouring with concrete in two steps. After threading the sheet metal components, for example, on the lowermost layer of the longitudinal reinforcement, the latter is suitable for being poured with the sheet metal components (at least in a thickness of 5 cm) and being transported to the construction site after hardening. This is where the upper longitudinal reinforcement layer is installed and the filling with concrete is carried out until the desired ceiling thickness is achieved. After the concrete hardens, the reinforced concrete component according to the present disclosure is finished.

BRIEF DESCRIPTION OF DRAWINGS

Further characteristics, details and advantages of the disclosure result from the text of the claims, as well as from the following description of embodiments on the basis of the figures. These figures show:

DETAILED DESCRIPTION OF DRAWINGS

Figure 1:
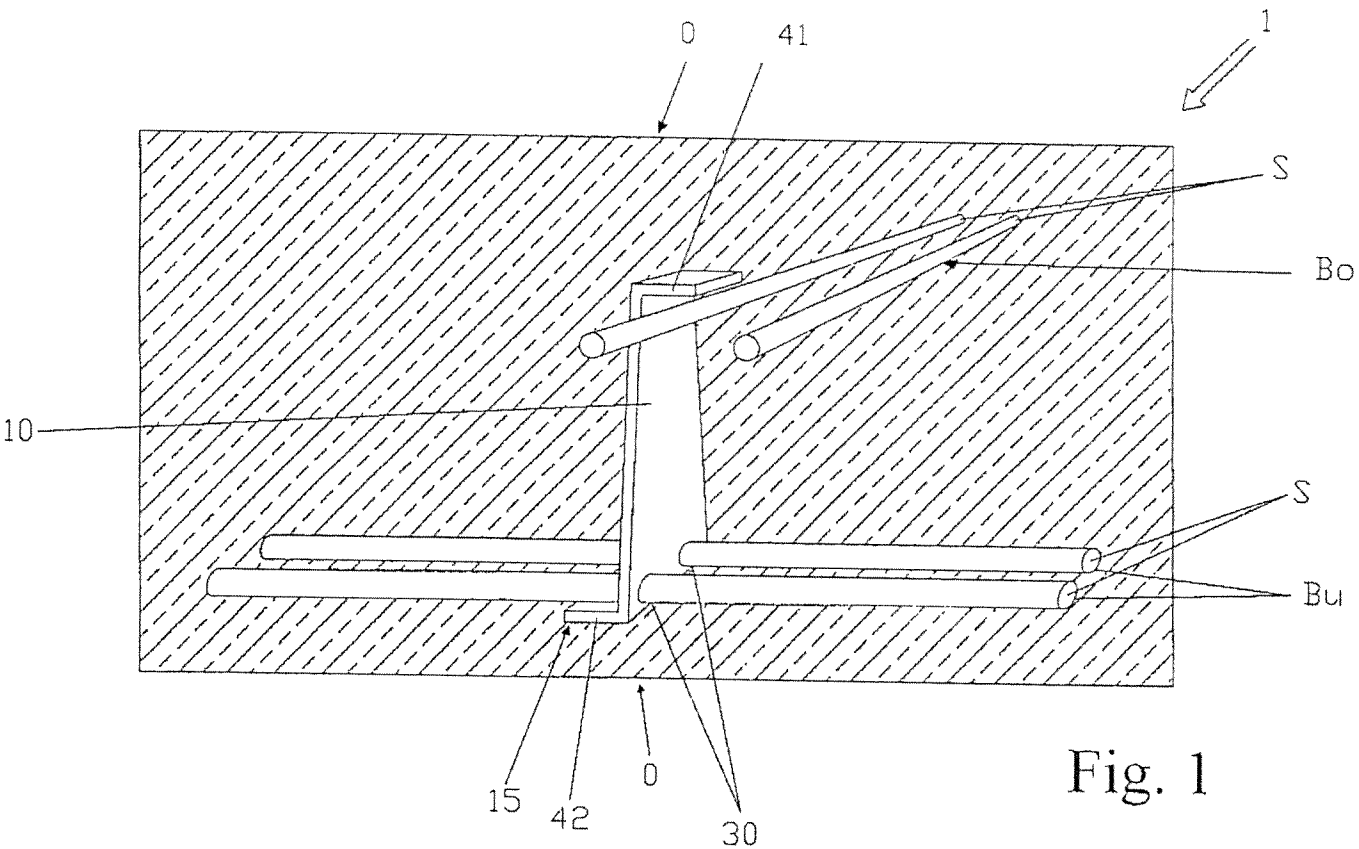
FIG. 1 is a section of a reinforced concrete component according to the present invention.

FIG. 1 shows a section of a reinforced concrete component 1 which comprises an upper reinforcement layer Bo and a lower reinforcement layer Bu formed from reinforcement bars S at the surfaces O of the concrete component. In order to increase the punching shear strength and the shear resistance, a trapezoidal sheet metal component 10 grasps the upper and the lower reinforcement layer Bo, Bu. The sheet metal component 10 is thereby in one direction parallel to the reinforcement and at a right angle to the surface of the concrete component O.

The chamfers 41, 42 forming a horizontal angle at both ends of the planar sheet metal component 10 grasp the upper reinforcement layer Bo and the lower reinforcement layer Bu. The reinforcement bars S are passed through the recesses 30 located in the lower area 15, connecting the sheet metal component 10 with the lower reinforcement layer Bu and securing its position relative to the reinforcement layer.

In the present example, the upper chamfer 41 is passed over the upper reinforcement layer Bo and grasps the latter. According to the present invention, this is not necessarily required. Equally, it would also be sufficient to pass the chamfer 41 to the same height as the upper reinforcement layer Bo. The composite action then also transfers the transverse forces from the upper reinforcement layer Bo by means of the planar sheet metal component 10 to the lower reinforcement layer Bu.

Figure 2C:
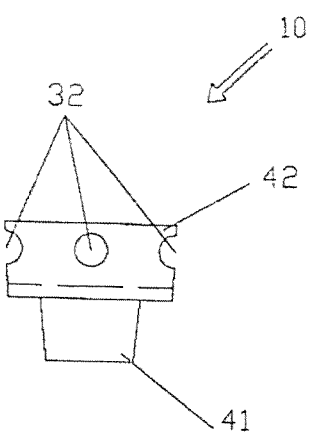
FIG. 2*c* is a sheet metal component viewed from above.
Figure 2B:
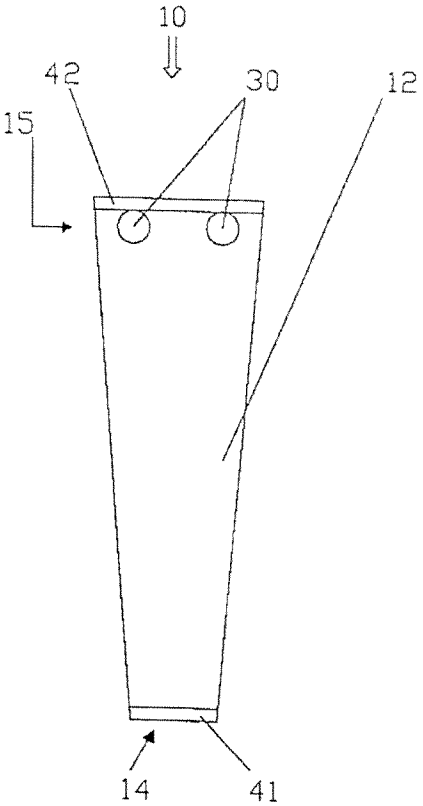
FIG. 2*b* is a sheet metal component in side view.
Figure 2A:
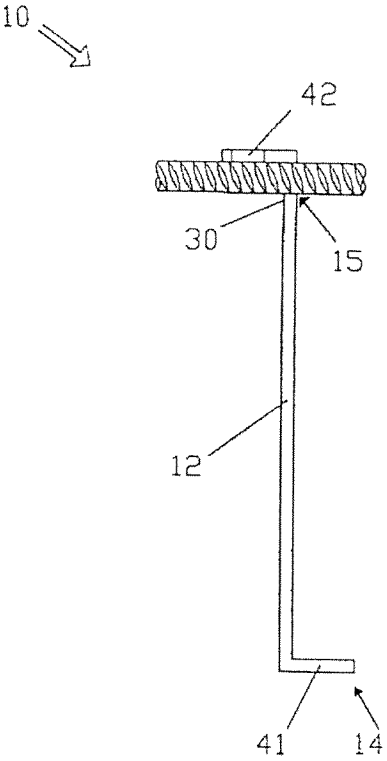
FIG. 2*a* is a sheet metal component in front view.

FIG. 2*a* shows a side view of a sheet metal component 10 according to the present invention to be used in a reinforced concrete component. As a main part 12, the sheet metal component 10 has a simple planar, trapezoidal body made from structural steel which comprises two recesses 30 in the form of holes in its lower area 15. The reinforcement bar S is hereby passed through the means of anchorage, which are arranged as circular recesses 30. The upper chamfer 41 is hereby primarily arranged at a right angle to the component 12. Here it is clearly recognizable that the lower chamfer 42 grasps a reinforcement bar S.

FIG. 2*b* shows a front view of the sheet metal component 10. One recognizes that the planar main part 12 of the sheet metal component 10 tapers from the lower end 15 to the upper end 14. The chamfers 41, 42 are hereby primarily arranged parallel to each other. Circular recesses 30 form means of anchorage to receive reinforcement bars S. The recesses 30 are hereby primarily arranged symmetrically to the longitudinal axis of the trapezoidal sheet metal component 10.

FIG. 2*c* shows a view of the sheet metal component 10 from above, whereby it is recognizable that the lower chamfer 42 also comprises recesses 32. The recesses 32 thereby significantly improve the composite action of the sheet metal component 10 in the reinforced concrete component 1. In the upper chamfer 41, a recess 32 is omitted in the present practical embodiment. Nevertheless, the upper chamfer according to the present invention is suitable to comprise recesses.

In FIGS. 2*a* to 2*c* it is easy to recognize that the chamfer 41, which is shaped on the upper area 14, is bent backward, whereas the chamfer 42 in the lower area 15 points forward. The sheet metal component 10 thus has a primarily Z-shaped form in its cross-section. The upper chamfer 41 is located at the height of the bending tensile reinforcement, whereas the lower chamfer 42 is arranged in the bending compression zone, wherein the chamfer, together with the threaded concrete reinforcing steel bars, produces anchorage for the punching shear reinforcement without being prone to slippage.

Figure 3:
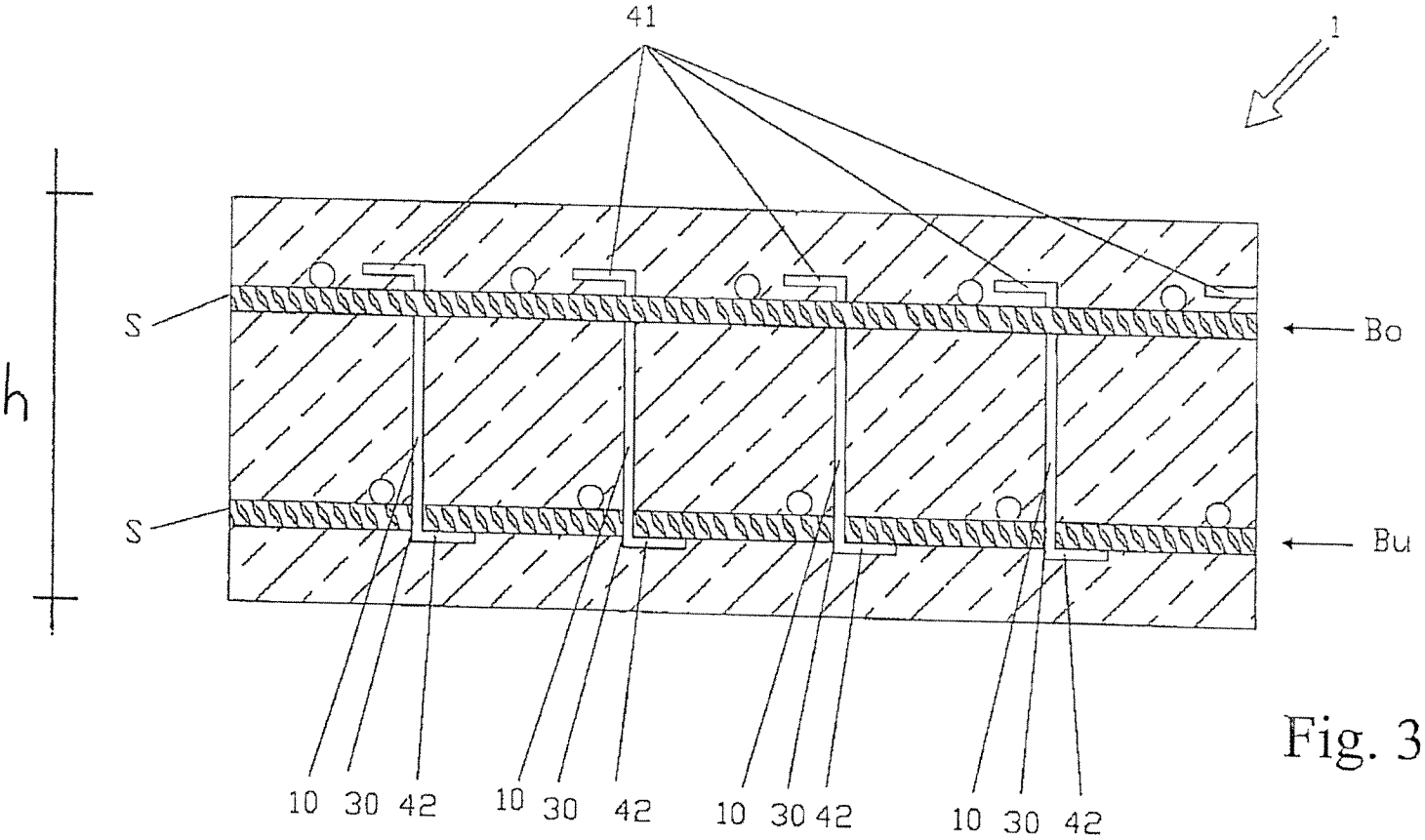
FIG. 3 is a section of a distribution of sheet metal components in a reinforced concrete component according to the present disclosure.

FIG. 3 shows a section of a reinforced concrete component according to the present invention with several sheet metal components 10. The lower chamfer 42 hereby anchors the outermost layer of the lower reinforcement Bu. Reinforcement bars S are thereby consecutively passed through the respective recesses 30 of a respective sheet metal component 10. Furthermore, this embodiment shows that the upper chamfers 41 do not necessarily have to be completely passed above the upper reinforcement layer Bo. It is already sufficient if the sheet metal component 10 with the respective chamfers is passed to, and not above, the reinforcement layers Bo, Bu.

Figure 4:
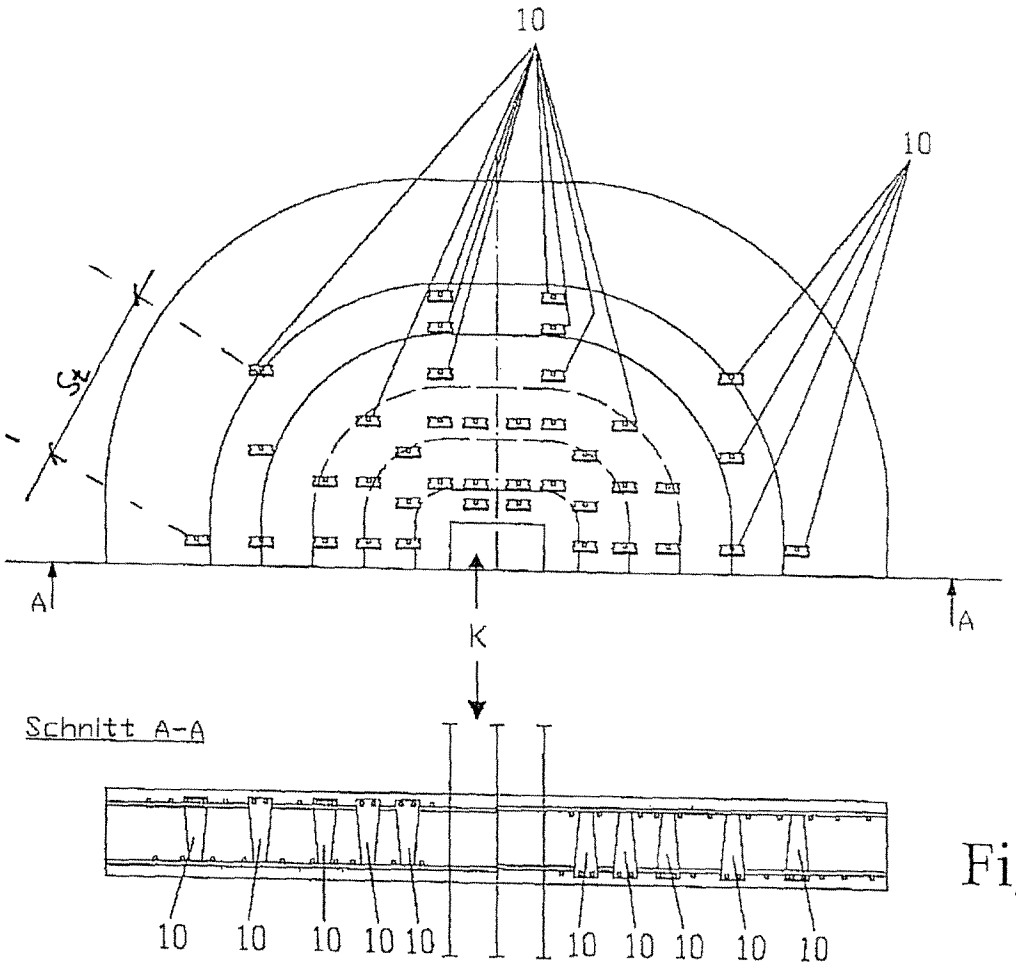
FIG. 4 is a reinforcement arrangement of a reinforced concrete component according to the present disclosure.

FIG. 4 shows a reinforced concrete component according to the present disclosure with a multiplicity of arranged sheet metal components. One recognizes that the sheet metal components are arranged around an area K. Furthermore, it is clearly recognizable that the sheet metal components are arranged parallel to each other.

The disclosure is not limited to one of the previously described embodiments; rather, it is suitable for being modified in all kinds of ways.

All of the characteristics and advantages originating from the claims, description and figures, including constructive details, spatial arrangements and processing steps are suitable to be essential to the invention, both in themselves and in the most diverse combinations.

I claim:

1. Reinforced concrete component comprising: at least one upper longitudinal reinforcement layer, at least one lower longitudinal reinforcement layer that is perpendicular to the at least one upper longitudinal reinforcement layer and one transverse force reinforcement, wherein the transverse force reinforcement extends such that it is passed above the uppermost and the lowermost longitudinal reinforcement, wherein the transverse force reinforcement is formed by at least 20 trapezoidal or triangular sheet metal components made from structural steel, wherein each sheet metal component comprises at its two ends one chamfer, respectively, and further comprises a z-shaped cross-section that grasps at least one reinforcement bar of the upper and one of the lower longitudinal reinforcement layer with the chamfers.

2. Reinforced concrete component according to claim 1, wherein the transverse force reinforcement comprises at least 50 sheet metal components.

3. Reinforced concrete component according to claim 1, wherein the transverse force reinforcement is particularly preferably formed by at least 70 sheet metal components.

4. Reinforced concrete component according to claim 1, wherein two circular recesses are arranged close to the chamfer at the broader end of the sheet metal component.

5. Reinforced concrete component according to claim 4, wherein a longitudinal reinforcement bar is passed through each recess.

6. Reinforced concrete component according to claim 1, wherein the chamfers are arranged with additional cut-outs.

7. Reinforced concrete component according to claim 1, wherein each sheet metal component comprises a thickness of 3 mm or 5 mm.

8. Reinforced concrete component according to claim 1, wherein the sheet metal components are arranged with uniform distribution around an area.

9. Reinforced concrete component according to claim 1, wherein the sheet metal components are arranged parallel to each other.

10. Reinforced concrete component according to claim 1, wherein the transverse force reinforcement is formed from so many sheet metal components made from structural steel that the equation $$\frac{\beta \cdot V_{Ed}}{u_{krit}} \leq v_{Rd,max}$$

is satisfied.

11. Reinforced concrete component according to claim 1, wherein the transverse force reinforcement is formed from so many sheet metal components made from structural steel that the equation $\beta \cdot V_{Ed} \leq v_{Rd,sy,Z}$ is satisfied.

12. Production method for a reinforced concrete component including at least one upper longitudinal reinforcement layer, at least one lower longitudinal reinforcement layer that is perpendicular to the at least one upper longitudinal reinforcement layer and one transverse force reinforcement, wherein the transverse force reinforcement extends such that it is passed above the uppermost and the lowermost longitudinal reinforcement in its extension, wherein the transverse force reinforcement is formed by at least 20 trapezoidal or triangular sheet metal components made from structural steel, wherein each sheet metal component comprises at its two ends one chamfer, respectively, and further comprises a z-shaped cross-section that grasps at least one reinforcement bar of the upper and one of the lower longitudinal reinforcement layer with the chamfers, the method comprising:

threading of the sheet metal components (10) onto a lowermost layer of the longitudinal reinforcement situating the sheet metal components towards a top to reach the upper reinforcement layer pouring with concrete.

13. Method according to claim 12, wherein pouring with concrete is carried out in two steps.

14. Production method for a reinforced concrete component including at least one upper longitudinal reinforcement layer, at least one lower longitudinal reinforcement layer that is perpendicular to the at least one upper longitudinal reinforcement layer and one transverse force reinforcement, wherein the transverse force reinforcement extends such that it is passed above the uppermost and the lowermost longitudinal reinforcement in its extension, wherein the transverse force reinforcement is formed by at least 20 trapezoidal or triangular sheet metal components made from structural steel, wherein each sheet metal component comprises at its two ends one chamfer, respectively, and further comprises a z-shaped cross-section that grasps at least one reinforcement bar of the upper and one of the lower longitudinal reinforcement layer with the chamfers, the method comprising:

threading of the sheet metal components onto the uppermost layer of the longitudinal reinforcement hanging the sheet metal components downward to reach the lower longitudinal reinforcement layer pouring with concrete.

15. Method according to claim 14, wherein pouring with concrete is carried out in two steps.

* * * * *